United States Patent [19]

Bernath

[11] 4,414,050

[45] Nov. 8, 1983

[54] METHOD AND APPARATUS FOR JOINING VENEER STRIPS

[75] Inventor: Oskar Bernath, Umiken, Switzerland

[73] Assignee: Georg Fischer Brugg-Oehler AG, Switzerland

[21] Appl. No.: 377,075

[22] Filed: May 11, 1982

[30] Foreign Application Priority Data

May 21, 1981 [CH] Switzerland ..... 3313/81

[51] Int. Cl.[3] ..... B27D 1/10; B27D 3/04

[52] U.S. Cl. ..... 156/166; 144/344; 156/304.3; 156/216; 156/497; 156/555; 156/558; 156/559

[58] Field of Search ..... 156/91, 157, 166, 304.3, 156/216, 497, 555, 558, 559; 144/245 A, 344

[56] References Cited

U.S. PATENT DOCUMENTS

| | | | |
|---|---|---|---|
| 3,579,405 | 5/1971 | Crawford | 156/559 |
| 3,686,057 | 8/1972 | Ortel | 156/558 |
| 4,042,440 | 8/1977 | Hasegawa et al. | 156/558 |
| 4,269,883 | 5/1981 | Hasegawa | 156/166 |

*Primary Examiner*—Michael G. Wityshyn

*Attorney, Agent, or Firm*—Roylance, Abrams, Berdo & Farley

[57] ABSTRACT

A method and apparatus for joining veneer strips with an adhesive string between the abutting edges of the veneer strips, which string forms loops between the edges of one side of the veneer, the string being pressed and cemented against the other side of the veneer. The loop is being made by lifting the adhesive string through the plane of movement of the veneer strips using a supply eye in front of a holding hook. Thereafter, the string is being hung into the holding hook by a swinging movement and a following return movement of the supply eye.

9 Claims, 7 Drawing Figures

22
33
66
34
4
44a
44
35
38
40
38
37
36
54
A
40a
39
39
46
46a
42
42
43
41
41
43
28
3

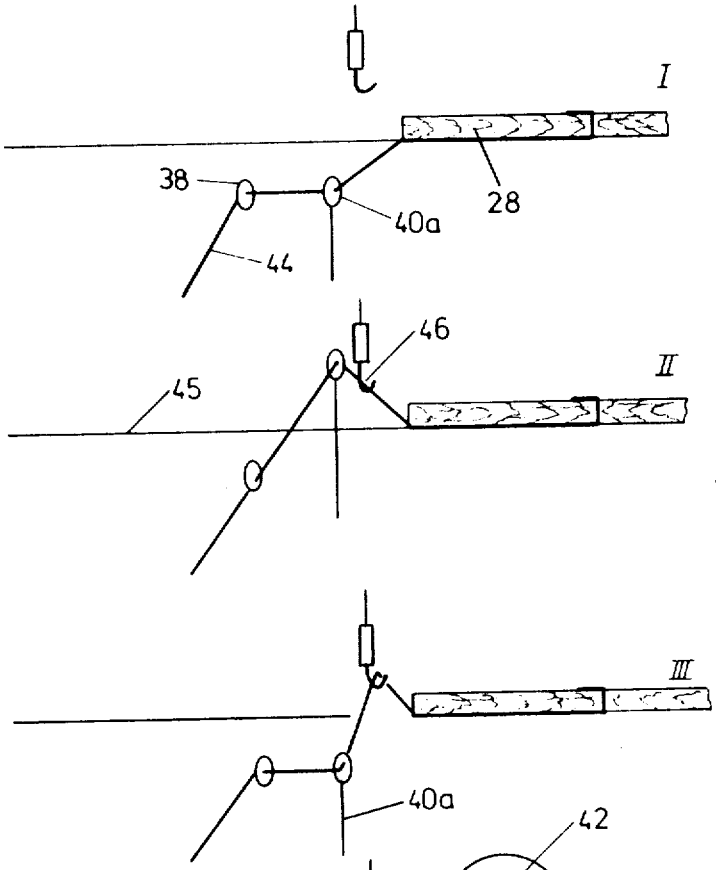
Fig. 3
Fig. 4
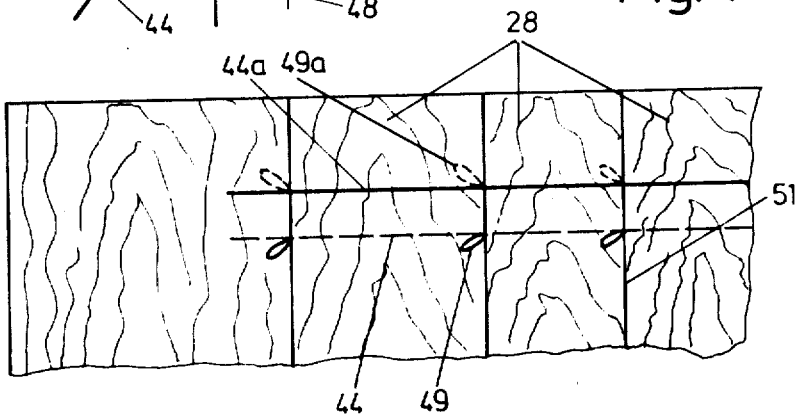

METHOD AND APPARATUS FOR JOINING VENEER STRIPS

This invention relates to a method and apparatus for joining veneer strips into a panel in such a way that the abutting side edges of the strips are generally parallel with the direction of the wood grain, and using adhesive strings extending perpendicular thereto.

BACKGROUND OF THE INVENTION

A method of joining panels using adhesive strings is disclosed in German Pat. No. 16 28 989 in which several adhesive strings, used in pairs, one each on the upper and lower surfaces in laterally spaced relationship from each other are placed on the veneer surfaces and are reversed at the longitudinal edges of each strip. To handle those string groups which are not located in the edge area, devices with supplies of the adhesive string must be moved from below the running veneer plane to the upper side of this plane, and in the opposite direction.

Also, German Pat. OS No. 27 15 522 shows an apparatus which also produces string crossing in the area of two abutting veneer strips wherein two string supply coils are turned stepwise through angles of 180° on divided chain wheels.

In both cases, because of the size of the panels to be produced, a large and, consequently, heavy string supply must be moved, requiring huge holding and moving devices which involve great masses, requiring considerable time for these devices to be moved from one side of the veneer plane to the other, resulting in very long running times and longer supply interruptions.

BRIEF DESCRIPTION OF THE INVENTION

An object of the present invention is to provide a method for forming veneer strips into a panel wherein, by simple movements, adhesive string connections can be produced with veneer strips.

A further object is to provide an apparatus for performing this method in which short working cycles and short interruptions of the supply, through the use of small moving masses, is possible.

Briefly described, the invention includes a method for joining a plurality of veneer strips into a panel so that abutting edges of the strips are generally parallel with the direction of the wood grain using adhesive strings, comprising the steps of extending a portion of at least one adhesive string across one major surface of a first veneer strip in a direction perpendicular with the strip plane, forming a loop at a side edge of the strip so that the string extends beyond the opposite surface of the first strip and back, moving a second strip into contiguous abutting relationship with the first so that the loop is caught between the side edges, bending the exposed portion of the loop onto the opposite surface of one of the contiguous strips, and pressing the loop portion to adhere it to said opposite surface, extending the adhesive string across the major surface of the second strip lying in the same plane as the one major surface of the first strip, and repeating the steps of forming loops, moving additional strips into contiguous relationship, and bending exposed portions of the loops to form a panel in which each string extends across only one panel surface.

In another aspect, the invention includes an apparatus for joining a plurality of veneer strips into a panel comprising means for supporting and moving a plurality of veneer strips, means for holding a supply coil of adhesive string; means for extending a portion of adhesive string from said coil across a major surface of a first veneer strip in a direction perpendicular with the grain thereof; means for forming a loop at a side edge of said first strip so that the string extends beyond the opposite surface of said first strip and back, means for moving a second strip into contiguous abutting relationship with said first strip so that the loop thus formed is caught between the strip edges, heated roller means for bending the exposed portion of the loop onto the opposite surface of one of said strips to adhere it to said surface; said means for extending being usable to place said string across the plane-parallel major surface of the second and subsequent strip between loops formed between contiguous edges thereof, in sequence.

As will be recognized, by forming loops between the abutting edges at the joints between the various veneer pieces, a good, firm connection is made between the strips, also forming a panel which is usable in bending operations, without the need for letting the adhesive material change surfaces between the upper and lower sides of the veneer strips.

By placing the adhesive string on only one veneer side, it is not necessary to move a supply coil for the adhesive string which is large in mass. As compared thereto, the mass of the loop forming devices is much smaller so that loop forming requires only very small interruptions. As a consequence, very short production times for joining veneer strips using adhesive strings results.

In order that the manner in which the foregoing and other objects are attained in accordance with the invention can be understood in detail, particularly advantageous embodiments thereof will be described with reference to the accompanying drawings, which form a part of this specification, and wherein:

FIG. 3 is a schematic diagram showing, in sequence, four steps I–IV in the method according to the invention;

FIG. 4 is a partial top plan view of a panel formed in accordance with the present invention;

Figure 1:
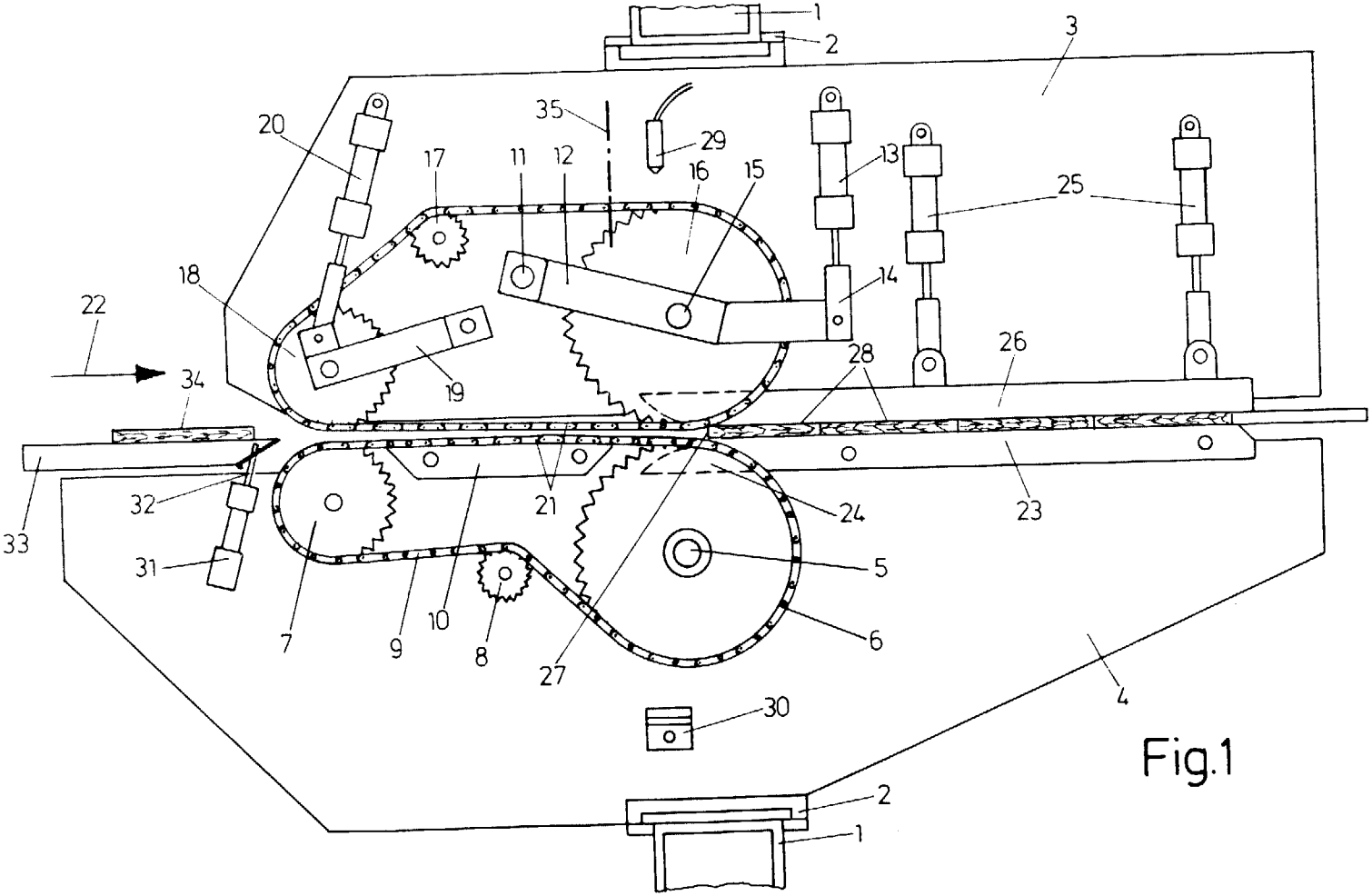
FIG. 1 shows a side elevation of an apparatus in accordance with the invention, particularly showing the veneer transport apparatus.

Turning now to the drawings in detail, FIG. 1 shows lower and upper guide members 1 of a machine support, only a portion of which is shown, on which an upper support 3 and a lower support 4 with ledges 2 are slidably mounted and, in use, are firmly clamped to the guides 1. On the lower support 4 an axle 5 is fixedly attached by screws, and a chain wheel or sprocket 6 is rotatably mounted on axle 5 and is driven by drive means, not shown. The sprocket 6 drives a transport chain 9 in the form of an endless loop, the chain passing around a direction reversing wheel 7 and passing across an idler sprocket 8. The upper portion of the transport chain 9 rests on a horizontal support 10.

On the upper support 3 is a lever 12 which is pivotally mounted about a point of rotation formed by a fixed axle 11. The lever can be loaded by means of a pneumatic piston and cylinder assembly 13 which is attached to lever 12 by a connecting link structure 14. Variable force can be applied by the piston and cylinder assembly. An axle 15 is supported on lever 12 and a sprocket 16 is rotatably mounted on axle 15, sprocket 16 again being driven by drive means, not shown. An endless transport chain couples chain wheel 16 to an idler pulley 17 and a direction reversing wheel 18 which is mounted on an axle attached to a pivotable lever 19. Wheel 18 can be moved with adjustable force by a piston and cylinder assembly 20. As will be recognized, the portions of the chain which are closest to each other and are generally parallel move in the direction of arrow 22.

Behind sprocket 6 is a clamping bar 23 which is fixedly attached to support 4 and which has a nose portion 24 protruding along the side of sprocket 6. Similarly, behind sprocket 16 is a clamping bar 26 which is vertically movable by means of pneumatically operated piston and cylinder assemblies 25. As will be seen, the bar 26 can be moved downwardly with adjustable force by means of variable air pressure supplied to cylinders 25.

Between clamping bars 23,26 veneer strips 28 are shown extending up to the delivery end 27. A photocell 29 cooperates with a reflector 30 and is connected with a pneumatic cylinder 31 which carries a stop needle 32 which protrudes to interrupt the supply of veneer strip 34 if the reflector 30 is occluded by a veneer strip 28. A table bar 33 serves as a support for veneer strip 34 which is to be supplied for assembly.

Figure 2:
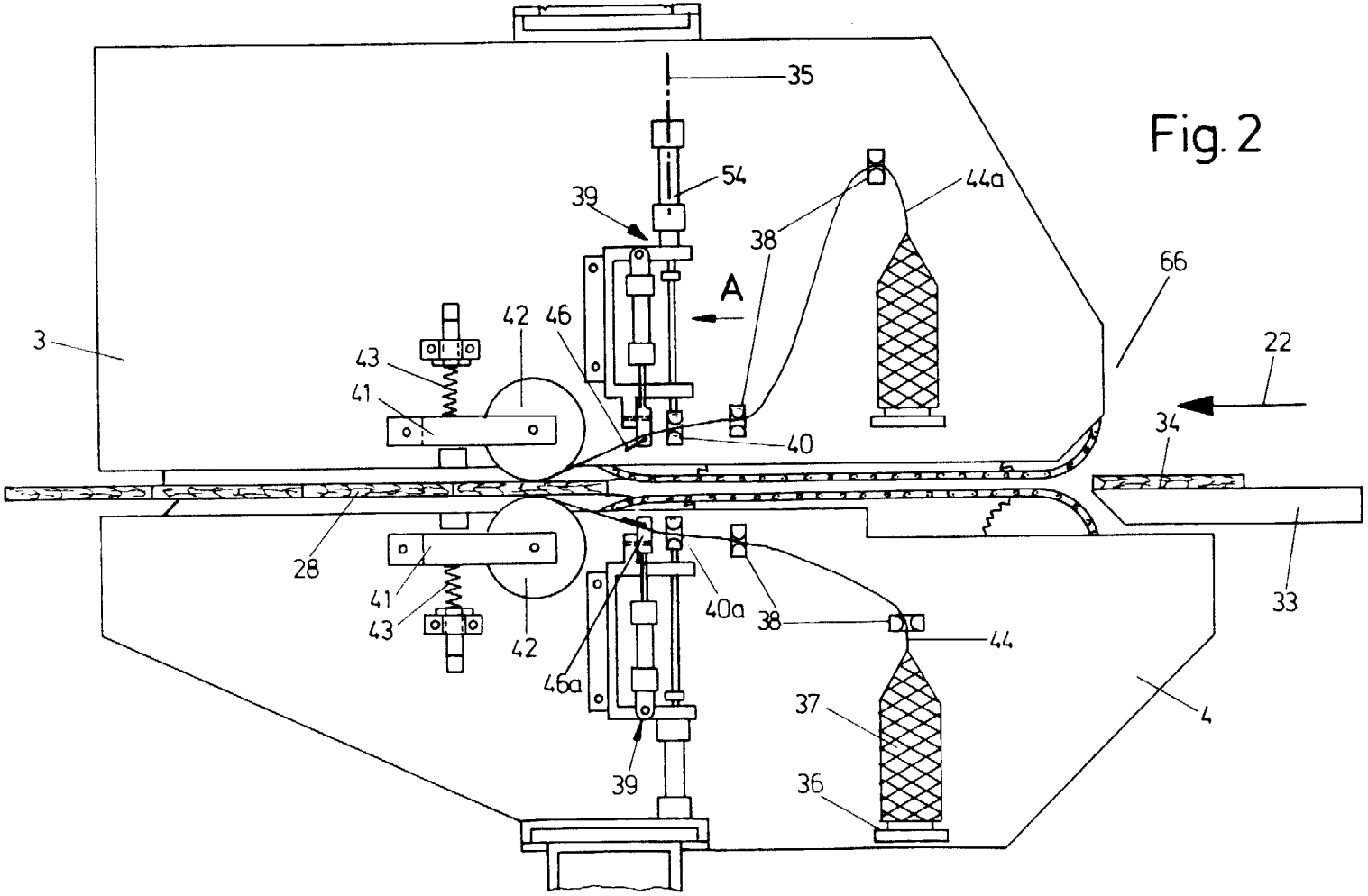
FIG. 2 is a side elevation of the apparatus of FIG. 1 from the opposite side.

The plane 35 is used as a reference plane in FIG. 1 and is identically positioned with reference plane 35 shown in FIG. 2.

FIG. 2 illustrates the upper and lower supports 3,4 with coil holders 36, string supply coils 37, string direction-changing eyes 38, and also loop formers 39 each of which has a supply eye 40,40*a* and a holding hook 46,46*a*. The supply eyes 40 and 40*a* are actively movable in plane 35. As will be recognized, the adhesive strings referred to are strings coated with adhesive which can be heat activated adhesive.

Behind the loop forming devices 39, string pressing wheels 42 are rotatably mounted on pivotable levers 41, the levers and, therefore, the wheels carried by them being pressed against the veneer strips 28 by adjustable springs 43.

The adhesive strings 44,44*a* extend from the string supply coils 37 through string guide eyes 38 and supply eyes 40,40*a* to the string pressing wheels 42.

FIG. 3 illustrates, in sequence, the four basic steps I–IV, in schematic views, which form the method for forming a loop with the string running underneath the veneer.

Step I shows the starting position in which the adhesive string 44 extends through a string guide eye 38 and a supply eye 40*a* and to a veneer strip 28.

In step II, the supply eye 40*a* is lifted above the veneer transport line 45 and above the upper veneer surface and a holding hook 46 is swung underneath the adhesive string 44. In step III, the string supply eye is pulled back down, below the lower veneer surface level.

Step IV shows the transportation of a second veneer strip 34 in the direction of the arrow 22 with the front edge 47 moved up to the stop line 48 so that the adhesive string forms a loop 49 which then slides out of the holding hook 46, and is pressed downwardly by the string pressing roller 42 in the direction of arrow 50 and is adhesively anchored to the upper surface of the veneer.

FIG. 4 shows a partial top plan view of an assembled veneer panel with lower and upper adhesive strings. The figures show several veneer strips 28, the side edges 51 of which are pressed tightly together in contiguous abutting relationship. In addition, the structure includes a lower adhesive string 44 with upper loops 49, and an upper adhesive string 44*a* with lower loops 49*a*.

Figure 5:
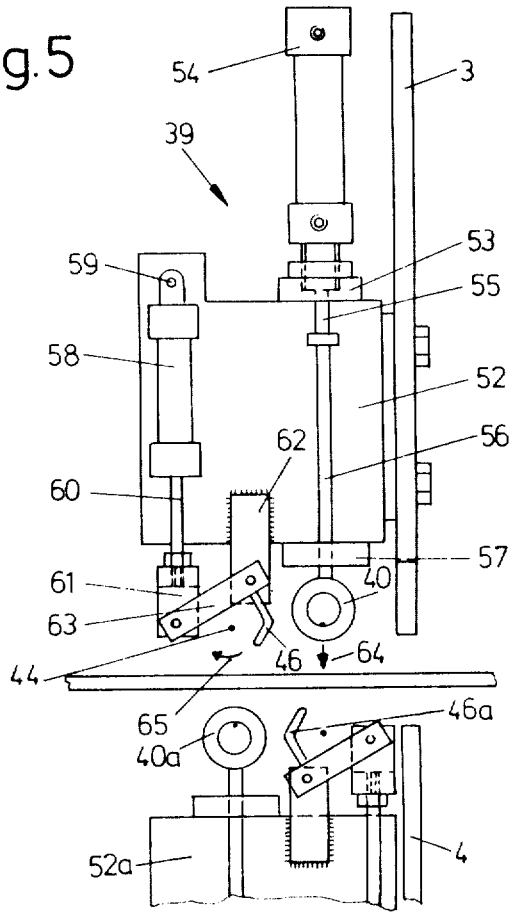
FIG. 5 is a partial front elevation of the apparatus of FIG. 2 in the direction of arrow A showing loop forming devices.

FIG. 5 shows lower and upper loop forming means 39 including holding plates 52,52*a* mounted on the upper and lower supports 3,4. The upper holding plate 52 has a fastening part 53 on which a pneumatic piston and cylinder assembly 54 is mounted. On the piston rod 55 thereof is connected an extension bar 56, secured against rotation, and carrying a supply eye 40, the bar 56 being centered by means of a guide member 57. Additionally, a pneumatic piston and cylinder assembly 58 is mounted so as to be pivotable about a point 59 on plate 52. Piston rod 60 of that piston and cylinder assembly is equipped with a fork 61 which is operatively connected with a link 63 pivotally attached at its other end to a bar 62, the link 63 carrying the holding hook 46.

The supply eye 40 moves in the direction of arrow 64 and back and the holding hook 46 moves in the direction of arrow 65, and back. The adhesive string 44 is shown in the catching position of the holding hook 46 and is seized by swinging movement of the hook 46 in the direction of arrow 65.

The lower holding plate 52*a* includes the same elements, the only difference being an alternating operating arrangement, so that the supply eye 40 can be brought into operative connection with the holding hook 46*a*. In FIG. 2 it is shown that the supply eyes 40,40*a* lie opposite to the holding hooks 46,46*a*, closer to the input side 66. The pneumatic cylinder assemblies 54,58 are moved by conventional remote controls, the details of which are conventional and not shown. Control is initialized by means of the stop needle 32 (FIG. 1) opening the input.

The loop 49 of an adhesive string 44, therefor, is formed by means of the lower supply eye 40*a* and the upper holding hook 46. The loop of an upper adhesive string 44*a* is formed by the upper supply eye 40 and the lower holding hook 46*a*.

Figure 6:
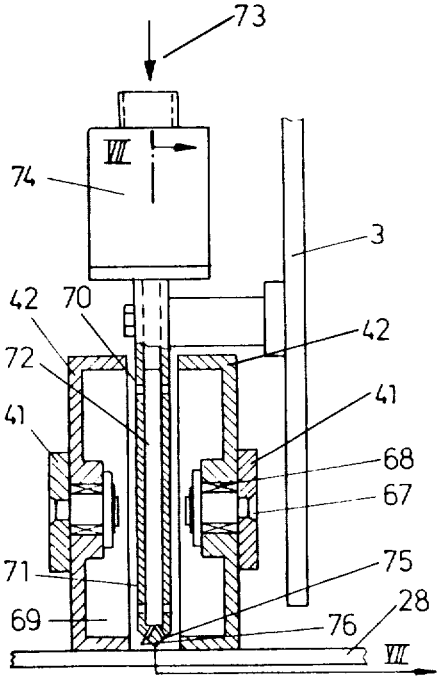
FIG. 6 is an enlarged front elevation, in partial section, of a roll for pressing adhesive string.

FIG. 6 shows a section through the upper roller arrangement for pressing the adhesive string including string pressing rollers 42 rotating on stub axles 67 which are carried in bearings 68. Rollers 42 have cutouts 69 pointing toward a housing 71 which is provided with holes 70. Housing 71 is formed with a hollow portion 72 into which air is introduced through the entry 73 by means of a heating element 74. The periphery of housing 71 is tapered as shown at 75, a portion of the taper being provided with holes 76.

Figure 7:
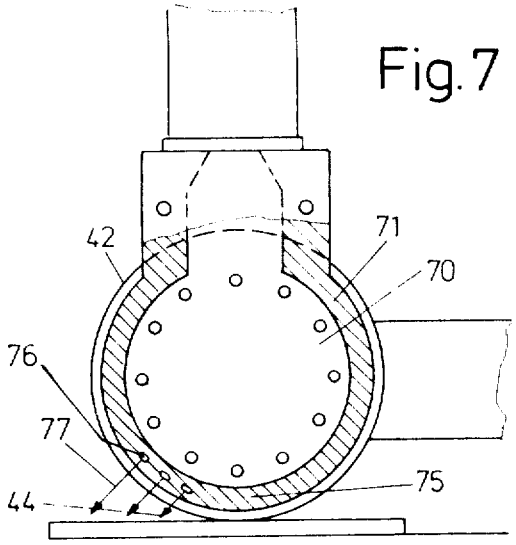
FIG. 7 is a side elevation, in section, along line VII—VII of FIG. 6.

FIG. 7 shows a section through the apparatus of FIG. 6 with the housing 71 and circularly arranged holes 70 therein, as well as with string pressing rollers 42. Furthermore, the holes 76 are shown in the tapered portion 75 which are pointing sideways to the direction 77 of running of adhesive string 44 and are used for preheating.

While certain advantageous embodiments have been chosen to illustrate the invention it will be understood by those skilled in the art that various changes and modifications can be made therein without departing from the scope of the invention as defined in the appended claims.

What is claimed is:

1. A method for joining a plurality of veneer strips into a panel so that abutting edges of the strips are generally parallel with the direction of the wood grain using adhesive strings, comprising the steps of extending a portion of at least one adhesive string across one major surface of a first veneer strip in a direction perpendicular with the strip grain;

forming a loop at a side edge of the strip so that the string extends beyond the opposite surface of the first strip and back;

moving a second strip into contiguous abutting relationship with the first so that the loop is caught between the side edges;

bending the exposed portion of the loop onto the opposite surface of one of the contiguous strips, and pressing the loop portion to adhere it to said opposite surface;

extending the adhesive string across the major surface of the second strip lying in the same plane as the one major surface of the first strip; and repeating the steps of forming loops, moving additional strips into contiguous relationship, and bending exposed portions of the loops to form a panel in which each string extends across only one panel surface.

2. A method according to claim 1 wherein a loop is made only in the adhesive strings running on one of the veneer surfaces.

3. A method according to claim 1 wherein two adhesive strings are used, the two strings being placed in substantially parallel laterally spaced relationship on opposite surfaces of the veneer strips, the loops being formed on opposite surfaces and also laterally spaced.

4. An apparatus for joining a plurality of veneer strips into a panel comprising means for supporting and moving a plurality of veneer strips;

means for holding a supply coil of adhesive string;

means for extending a portion of said adhesive string from said coil across a major surface of a first veneer strip in a direction perpendicular with the grain thereof;

means for forming a loop at a side edge of said first strip so that the string extends beyond the opposite surface of said first strip and back;

means for moving a second strip so that its edge is in contiguous abutting relationship with said edge of said first strip so that the loop thus formed is caught between the strip edges; and heated roller means for bending the exposed portion of the loop onto said opposite surface of one of said strips to adhere it to said surface, said means for extending being usuable to place said string across the plane-parallel major surface of the second and subsequent strips between loops formed between contiguous edges thereof, in sequence.

5. An apparatus according to claim 4, wherein said means for forming a loop comprises a movable supply eye on one side of the veneer strips and a swingable holding hook on the opposite side of the veneer surface, said supply eye being movable to carry an adhesive string in front of said holding hook, said adhesive string being firmly held by said holding hook during the return movement of the supply eye, thereby forming the loop.

6. An apparatus according to claim 5, wherein means for forming a loop is provided on each side of said veneer strips, said means on one side of the veneer being opposed to said means on the other side of the veneer, so that the supply eyes are displaced in a plane perpendicular to the direction of movement of said strips.

7. An apparatus according to one of the claims 5 or 6, and comprising means for moving said supply eyes and for swinging said holding hooks, said means comprising a plurality of pneumatic piston and cylinder assemblies.

8. An apparatus according to claim 4, wherein said roller means includes string pressure rollers having recesses arranged in opposed pairs, said rollers being mountd by bolts on force-operated levers.

9. An apparatus according to claim 8, wherein a housing is placed between the pair of string pressure rollers, said rollers having side holes and holes on a portion of the housing periphery directed toward the string inlet, and further comprising means for supplying heated air to the housing via a heating element.

* * * * *